US010910723B2

(12) United States Patent
Zhao

(10) Patent No.: US 10,910,723 B2
(45) Date of Patent: Feb. 2, 2021

(54) PLANAR ANTENNA FOR DIGITAL TELEVISION

(71) Applicant: SHENZHEN TUKO TECHNOLOGY CO, LTD., Shenzhen (CN)

(72) Inventor: Guodong Zhao, Shenzhen (CN)

(73) Assignee: SHENZHEN TUKO TECHNOLOGY CO, LTD., Guangdong (CN)

( * ) Notice: Subject to any disclaimer, the term of this patent is extended or adjusted under 35 U.S.C. 154(b) by 0 days.

(21) Appl. No.: 16/553,251

(22) Filed: Aug. 28, 2019

(65) Prior Publication Data

US 2020/0274243 A1 Aug. 27, 2020

(30) Foreign Application Priority Data

Feb. 22, 2019 (CN) ..... 2019 2 02391474 U

(51) Int. Cl.

| | |
|---|---|
| ***H01Q 9/28*** | (2006.01) |
| ***H01Q 5/307*** | (2015.01) |
| ***H01Q 5/364*** | (2015.01) |
| ***H01Q 9/40*** | (2006.01) |
| ***H01Q 1/22*** | (2006.01) |
| ***H01Q 1/38*** | (2006.01) |

(52) U.S. Cl.

CPC ..... *H01Q 9/285* (2013.01); *H01Q 1/22* (2013.01); *H01Q 1/38* (2013.01); *H01Q 5/307* (2015.01); *H01Q 5/364* (2015.01); *H01Q 9/40* (2013.01)

(58) Field of Classification Search

None

See application file for complete search history.

(56) References Cited

U.S. PATENT DOCUMENTS

| | | | | |
|---|---|---|---|---|
| 7,088,299 | B2 * | 8/2006 | Siegler | H01Q 1/2258 343/745 |
| 7,138,948 | B2 * | 11/2006 | Yeh | H01Q 1/38 343/700 MS |
| D656,131 | S * | 3/2012 | Suleiman | D14/230 |
| 9,118,114 | B2 * | 8/2015 | Kagaya | H01Q 1/3291 |
| D754,641 | S * | 4/2016 | Suleiman | D14/230 |
| 9,553,354 | B2 * | 1/2017 | Bedicks Junior | H01Q 9/32 |

(Continued)

*Primary Examiner* — Vibol Tan

(57) ABSTRACT

A planar antenna for digital television, wherein the planar antenna for digital television comprises a substrate, and a low-frequency radiation line and a high-frequency radiation line arranged on the substrate, the length of the low-frequency radiation lines being one quarter of a wavelength corresponding to the VHF frequency band, and the length of the high-frequency radiation lines being one quarter of a wavelength corresponding to the UHF frequency band. Under the condition of ensuring that the existing overall size of the antenna remains the same, by adding a low-frequency radiation line on the substrate, and making the length of the high-frequency radiation line being one quarter of the wavelength corresponding to the UHF frequency band, and making the length of the low-frequency radiation line being one quarter of the wavelength corresponding to the VHF frequency band, the planar antenna for digital television of the present utility model realizes full-frequency reception of the planar antenna for digital television, enhances the low-frequency receiving capability of the digital planar antenna, and optimizes the UHF gain.

9 Claims, 4 Drawing Sheets

(56) References Cited

U.S. PATENT DOCUMENTS

| | | | | |
|---|---|---|---|---|
| 2010/0259451 | A1* | 10/2010 | Chang | H01Q 9/285 343/700 MS |
| 2019/0363420 | A1* | 11/2019 | Yoshino | H01Q 5/364 |
| 2020/0153078 | A1* | 5/2020 | Inoue | B60Q 1/44 |

* cited by examiner

PLANAR ANTENNA FOR DIGITAL TELEVISION

CROSS REFERENCE TO RELATED APPLICATION

This application claims priority under 35 U.S.C. § 119 from Chinese Patent Application No. 2019202391474, filed Feb. 22, 2019, the subject matter of which is incorporated herein by reference in its entirety.

DESCRIPTION OF THE INVENTION

Technical Field

The present utility model relates to the technical field of antennas, and in particular relates to a planar antenna for digital television.

Background Art

Most of the television planar antennas available at present on the market receive only the UHF high frequency band. Some products that can receive low frequencies can only be realized by active amplifiers or adding telescopic antennas. The cost of using both methods is high, and thus results in low cost-effectiveness of the products.

The above content is merely for facilitating understanding of the technical solutions of the present utility model, and does not represent an admission that the above content is prior art.

Utility Model Content

The main purpose of the present utility model is to propose a planar antenna for digital television, which is capable of receiving high frequency band and low frequency band with a small size, enhancing the capability of the digital planar antenna for receiving low-frequency, and optimizing the gain of the UHF frequency band.

To achieve the above purpose, the planar antenna for digital television provided by the present utility model comprises a substrate and a low-frequency radiation line and a high-frequency radiation line arranged on the substrate, wherein the length of the low-frequency radiation line is one quarter of a wavelength corresponding to the VHF frequency band, and the length of the high-frequency radiation line is one quarter of a wavelength corresponding to the UHF frequency band.

Optionally, the low-frequency radiation line comprises two first radiation lines arranged symmetrically and spaced apart, and the digital planar antenna further comprises a coaxial cable, a signal line of the coaxial cable is electrically connected with one of the first radiation lines, and a ground line of the coaxial cable is electrically connected with the other of the first radiation lines.

Optionally, the first radiation line comprises a connecting segment, a bending segment and a curved segment which are sequentially connected, and the connecting segments of the two first radiation lines extend in parallel, and a space between the two bending segments is arranged to increase from the connecting segments toward the curved segments.

Optionally, an angle between the two bending segments of the two first radiation lines ranges from 70° to 80°. Optionally, an extended trajectory of the curved segment is arranged to coincide with a corner of the substrate.

Optionally, the connecting segment, the bending segment and the curved segment are enclosed to form an accommodating space, and the high-frequency radiation line comprises two second radiation lines arranged symmetrically and spaced apart, each of the second radiation lines being respectively connected to one of the connecting segments and housed in the accommodating space.

Optionally, an angle between the two second radiation lines ranges from 100° to 110°. Optionally, the high-frequency radiation line further comprises two third radiation lines arranged symmetrically and spaced apart, the third radiation lines being arranged in a triangle; the two third radiation lines are correspondingly connected to the two second radiation lines; and one of the third radiation lines is electrically connected to the signal line of the coaxial cable, and the other of the third radiation lines is electrically connected to the ground line of the coaxial cable.

Optionally, the two third radiation lines are formed by coating the conductive silver paste.

Optionally, the middle of the two third radiation lines is arranged to be hollowed out.

Optionally, the substrate is a plastic sheet, and the material thereof comprises polycarbonate PC, or polyvinyl chloride PVC, or polyethylene terephthalate PET, or amorphous polyethylene terephthalate APET, or polypropylene PP, or polyurethane PU; and the corresponding wavelengths of the VHF frequency band and the UHF frequency band are respectively the medium wavelengths. Optionally, the curved segments are arranged in a zigzag or serpentine shape.

Under the condition of ensuring that the existing overall size of the antenna remains the same, by adding a low-frequency radiation line on the substrate, and making the length of the high-frequency radiation line being one quarter of the wavelength of the medium corresponding to the UHF frequency band, and making the length of the low-frequency radiation line being one quarter of the wavelength of the medium corresponding to the VHF frequency band, as compared with achieving low-frequency reception by active amplifiers and telescopic antennas, the planar antenna for digital television of the present utility model realizes full-frequency reception of the planar antenna for digital television with a small size, enhances the low-frequency receiving capability of the digital planar antenna, and optimizes the gain; and the antenna structure is integrated, the production efficiency is high, the consistency is good, and the cost is low.

BRIEF DESCRIPTION OF THE DRAWINGS

Inorder to more clearly illustrate the embodiments of the present utility model or the technical solutions in the prior art, the drawings to be used in the embodiments or the description of the prior art will be briefly described below. It is apparant that the drawings in the following description are merely some embodiments of the present utility model, and those skilled in the art can obtain other drawings according to the structures shown in the drawings without any creative work.

DESCRIPTION OF THE REFERENCE NUMERALS

Figure 1:
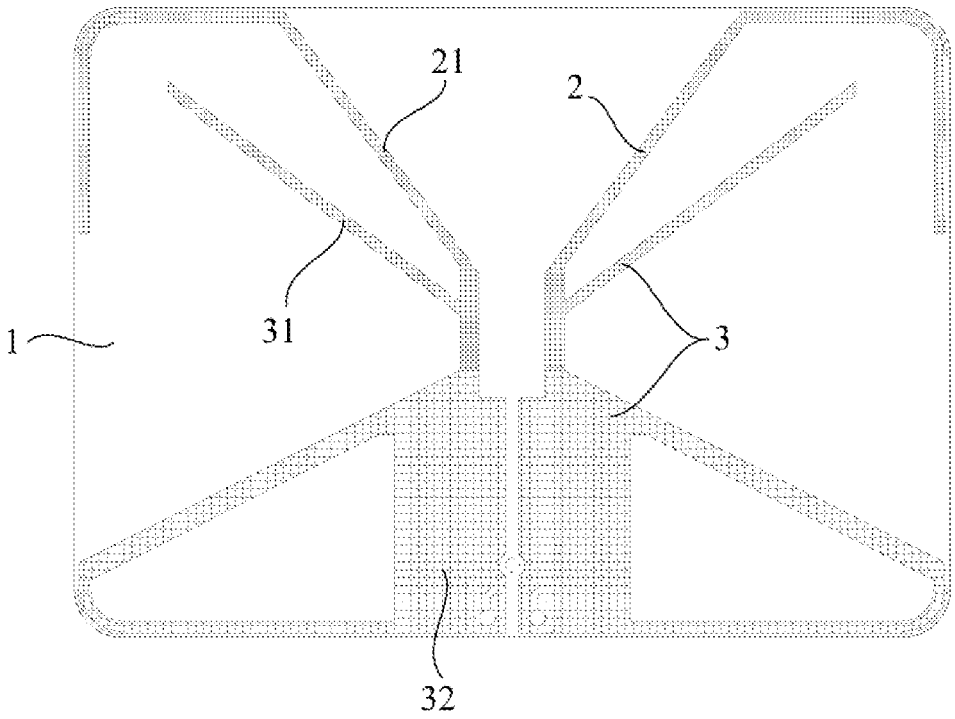
FIG. 1 is a structure schematic of an embodiment of a planar antenna for digital television according to the present utility model.

| numeral | Name | numeral | Name |
|---|---|---|---|
| 1 | Substrate | 3 | High-frequency |
| 2 | Low-frequency radiation line | 31 | Second radiation line |
| 21 | First radiation line | 32 | Third radiation line |
| 211 | Connecting segment | 4 | Coaxial cable |
| 212 | Bending segment | 41 | Signal line |
| 213 | Curved segment | 42 | Ground line |
| 214 | Accommodating space | | |

The implementation, functional features and advantages of the present utility model will be further described in conjunction with the embodiments and with reference to the accompanying drawings.

DETAILED DESCRIPTION

The technical solutions in the embodiments of the present utility model will be described below clearly and thoroughly in conjunction with the accompanying drawings in the embodiments of the present utility model. It is apparant that the described embodiments are merely a part of the embodiments of the present utility model, and not all of them. Based on the embodiments of the present utility model, all other embodiments obtained by those skilled in the art without creative efforts fall within the scope of protection of the present utility model.

It should be noted that if there is a directional indication (such as up, down, left, right, front, back, . . . ) in the embodiment of the present utility model, the directional indication is only used to explain the relative positional relationship, the movement, etc. between the various components in a certain arrangement (such as the drawing shown), and if the certain arrangement changes, the directional indication changes accordingly.

In addition, when it refers to "first", "second", etc. in the embodiments of the present utility model, the reference of "first", "second", etc. is used for the purpose of description only, and should not be understood as indicating or implying its relative importance or implicitly indicating the number of technical features indicated. Thus, features defined with "first" or "second" may include at least one of the features explicitly or implicitly. In addition, the term of "and/or" included in the whole text means there are three parallel schemes, taking "A and/or B" as an example, including A scheme, or B scheme, or a scheme that both include A and B.

In addition, the technical solutions between the various embodiments may be combined with each other, but must be based on a condition that the combined solution can be realized by those skilled in the art. If the combined technical solution is contradictory or impossible to implement, it should be considered that the combination of the technical solutions does not exist, and not fall within the scope of protection of the present utility model.

The present utility model provides a planar antenna for digital television, which is suitable for household digital television. In the embodiment of the present utility model, as shown in FIG. 1, the planar antenna for digital television includes a substrate 1, a low frequency radiation line 2 and a high frequency radiation line 3 disposed on the substrate 1. The length of the low frequency radiation line 2 is one quarter of the wavelength corresponding to the VHF band, and the length of the high frequency radiation line 3 is one quarter of the wavelength corresponding to the UHF band.

The substrate is a plastic sheet, and the material thereof comprises PC, or PVC, or PET, or APET, or PP, or PU; and the corresponding wavelengths of the VHF band and the UHF band are respectively medium wavelengths.

When the lengths of the low-frequency radiation line 2 and the high-frequency radiation line 3 are both one quarter of the wavelength of the radio signal, the antenna has the highest emission and conversion efficiency. Under the condition of ensuring that the existing overall size of the antenna remains the same, by adding a low-frequency radiation line 2 on the substrate 1, and making the length of the high-frequency radiation line 3 being one quarter of the wavelength corresponding to the UHF frequency band, and making the length of the low-frequency radiation line 2 being one quarter of the wavelength corresponding to the VHF frequency band, as compared with achieving low-frequency reception by active amplifiers and telescopic antennas, the planar antenna for digital television of the present utility model realizes full-frequency reception of the planar antenna for digital television with a small size, enhances the capability of the digital planar antenna for receiving low-frequency, and optimizes the gain; and the antenna structure is integrated, the production efficiency is high, the consistency is good, and the cost is low.

Figure 2:
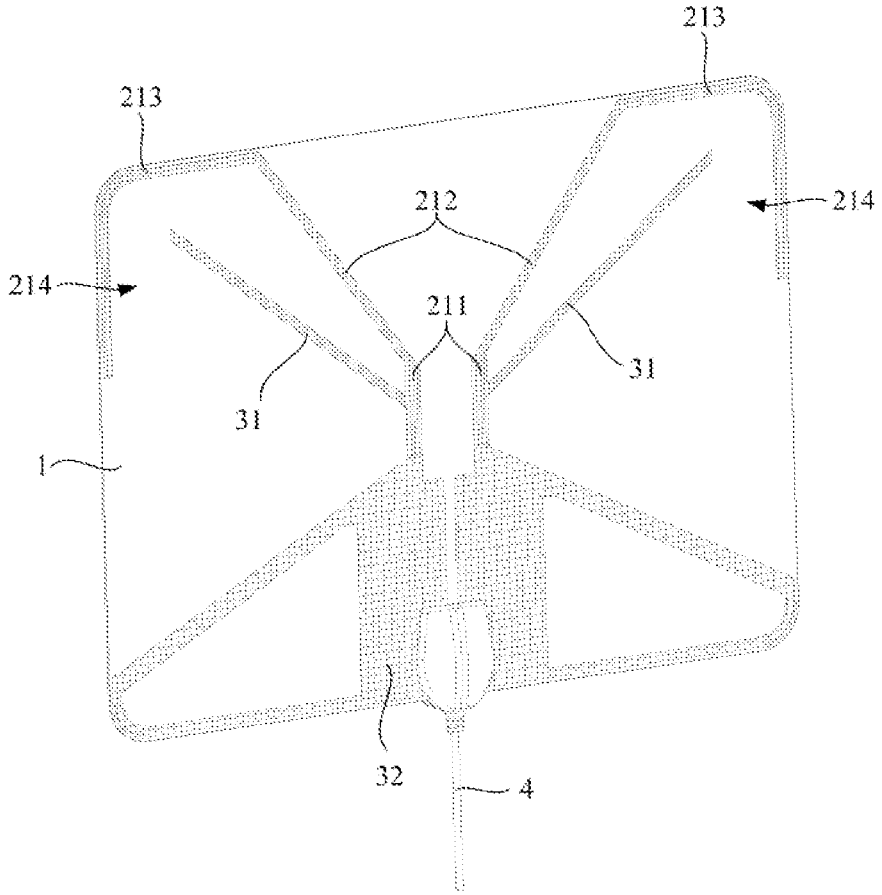
FIG. 2 is a structure schematic of another embodiment of a planar antenna for digital television according to the present utility model.
Figure 3:
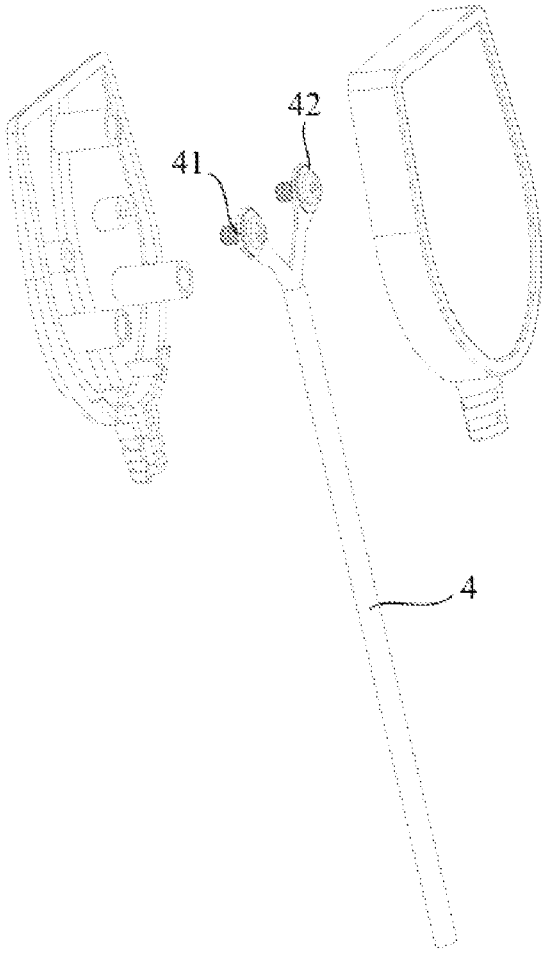
FIG. 3 is a partial explosive structure schematic of the planar antenna for digital television of FIG. 2.

Further, referring to both FIG. 2 and FIG. 3, the low-frequency radiation line 2 comprises two first radiation lines 21 arranged symmetrically and spaced apart, and the digital planar antenna further comprises a coaxial cable, a signal line 41 of the coaxial cable is electrically connected with one of the first radiation lines 21, and a ground line 42 of the coaxial cable is electrically connected with the other of the first radiation lines 21.

In the present embodiment, two first radiation lines 21 arranged symmetrically and spaced apart are electrically connected with the signal line 41 and the ground line 42 of the coaxial cable, respectively, so as to feed the power. The low-frequency radiation line 2 is responsible for receiving the television program in the VHF frequency band, so that the planar antenna for digital television has a standing wave ratio of less than three in the VHF frequency band and a gain of 1 dbi.

Further, the first radiation line 21 comprises a connecting segment 211, a bending segment 212 and a curved segment 213 which are sequentially connected, and the connecting segments 211 of the two first radiation lines 21 extend in parallel, and a space between the two bending segments 212 is arranged to increase from the connecting segments 211 toward the curved segments.

In the present embodiment, the first radiation line 21 may be elongated. The space between the two bending segments 212 of the first radiation line 21 is arranged to increase from the connecting segments 211 toward the curved segments, so that the two first radiation lines 21 are substantially in a curved arrangement away from each other, which can optimize impedance matching and is more suitable for the size and shape of the substrate 1 and make the antenna as a whole more aesthetic.

Further, an angle between the two bending segments 212 of the two first radiation lines 21 ranges from 70° to 80°. In this range of angle, it is possible to optimize impedance matching, reduce the standing wave ratio, obtain higher gain, and make the size of the first radiation line 21 more reasonable while ensuring the above effects.

Further, referring to FIG. 1 and FIG. 2, the extended trajectory of the curved segment is arranged to coincide with the corner of the substrate 1. In this way, the size of the substrate 1 can be used in a maximized manner, the number of bends can be reduced, the design of the first radiation line 21 can be simplified, and space can also be provided for other lines, thereby miniaturizing the antenna.

Further, the connecting segment 211, the bending segment 212 and the curved segment are enclosed to form an accommodating space 214, and the high-frequency radiation line 3 comprises two second radiation lines 31 arranged symmetrically and spaced apart, each of the second radiation lines 31 being respectively connected to one of the connecting segments 211 and housed in the accommodating space 214.

In the present embodiment, the second radiation line 31 can be arranged in an elongated shape. It can be understood that since the length of the first radiation line 21 is longer than the length of the second radiation line 31, the second radiation line 31 is accommodated in the accommodating space 214 formed by the first radiation line 21, so that the entire line structure is more compact, thus the area of the substrate 1 is fully utilized, and the reception of full-frequency can be achieved by the planar antenna for digital television in a small size. Each of the second radiation lines 31 is connected to a connecting segment 211, thus the first radiation line 21 shares a same part of the line with the second radiation line 31, so that the line structure is more compact, the antenna is integrated, and the consistency is good without affecting the performance during the use.

Further, the angle between the two second radiation lines 31 ranges from 100° to 110°. In this range of angle, it is possible to optimize impedance matching, reduce the standing wave ratio, obtain higher gain, and make the size of the first radiation line 21 more reasonable while ensuring the above effects. The two second radiation lines 31 are responsible for receiving television programs in the UHF frequency band, such that the planar antenna for digital television has a standing wave ratio of less than two in the UHF frequency band and a gain of 5 dBi.

Moreover, the high-frequency radiation line 3 further comprises two third radiation lines 32 arranged symmetrically and spaced apart, and the third radiation lines 32 are arranged in a triangle shape; the two third radiation lines 32 are connected to the two second radiation lines 31 respectively; and one of the third radiation lines 32 is electrically connected to the signal line 41 of the coaxial cable, and the other of the third radiation lines 32 is electrically connected to the ground line 42 of the coaxial cable.

In the present embodiment, the two third radiation lines 32 arranged in a triangle shape and symmetrically arranged can expand the bandwidth, so that the high-frequency radiation line 3 obtains a higher gain, thereby improving the receiving effect of the antenna.

Two power-feeding points are respectively disposed on the two third radiation lines 32, and are respectively connected with the signal line 41 and the ground line 42 of the coaxial cable to realize power-feeding. In an embodiment, as shown in FIG. 3, the planar antenna for digital television further comprises a clip (not shown), one end of the clip (not shown) is connected to the coaxial cable, and the other end clamping the substrate 1. The clip (not shown) is fixed on the position of the corresponding power-feeding point on the substrate 1, and the coaxial cable and the substrate 1 are fixed by clips (not shown), and the structure is simple and easy to disassemble.

Further, the two third radiation lines 32 are formed by coating with the conductive silver paste. Of course, the first radiation line 21 and the second radiation line 31 can also be formed by coating with the conductive silver paste. During manufacturing, the radiation lines can be meshed or not meshed, achieving the same receiving effect of the antenna. In other embodiments, the high-frequency radiation line 3 and the low-frequency radiation line 2 can also be formed of copper foil, aluminum foil, or the like.

Further, referring to FIG. 1 and FIG. 2, the middle of the two third radiation lines 32 is hollowed out. The hollow shape and size of the middle of the third radiation line 32 are not limited. By making the middle of the third radiation line 32 hollow, the amount of the conductive silver paste used can be reduced without affecting the receiving effect of the antenna, thereby reducing the manufacturing cost.

Among the above, VHF is the abbreviation of Very High Frequency, which refers to radio waves with a frequency band from 30 Mhz to 300 MHz and a wavelength of 1 m~10 m; UHF is the abbreviation of Ultra High Frequency, which refers to radio waves with a frequency of 300~3000 MHz and a wavelength of 1 m~1 dm.

The frequency range of the VHF in this embodiment is FM (88-108 MHz), HI_VHF (174-230 MHz). Based on the above implementation, the present embodiment can arrange the curved segment of the low-frequency radiation line 2 in a zigzag shape, as shown in FIG. 2, such that the length of the low-frequency radiation line 2 is one quarter of the wavelength of the medium of the corresponding frequency band, the high-frequency radiation line 3 is set to one quarter of the wavelength of the medium of the corresponding frequency band, and the angle between the two bending segments 212 of the two first radiation line 21 has a range of up to 70°; and the angle between the two second radiation lines 31 has a range of up to 110°; as such, the high-frequency gain is optimized under the condition of setting with small size, and the low-frequency gain is also maximally increased.

Figure 4:
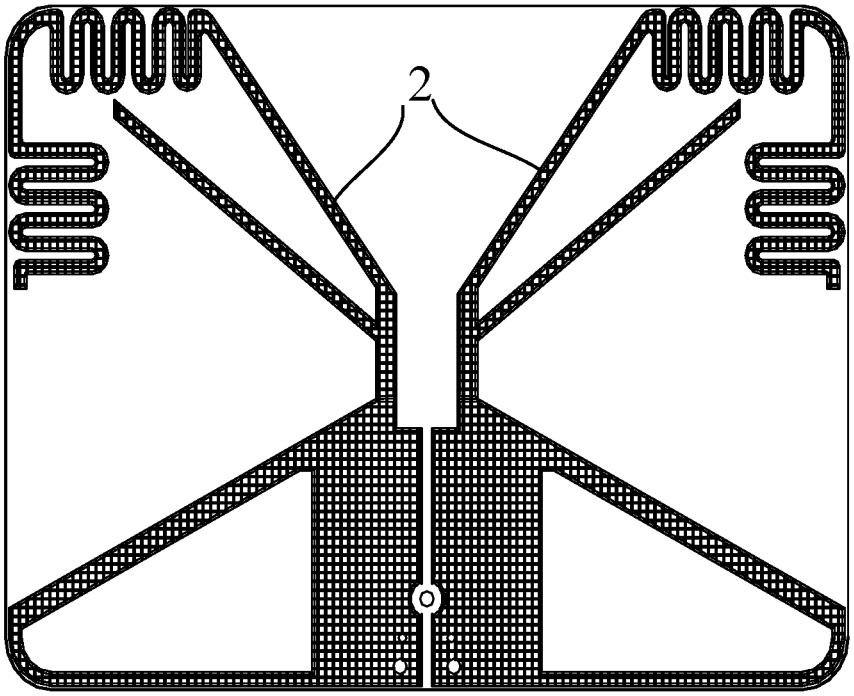
FIG. 4 is a structure schematic of the curved segment of the low-frequency radiation line being arranged in a serpentine shape in the present utility model.

Alternatively, the curved segment of the low-frequency radiation line 2 may be arranged in a serpentine shape, as shown in FIG. 4, such that the length of the low-frequency radiation line 2 is one quarter of the wavelength of the medium of the corresponding frequency band. The high-frequency radiation line 3 is set to a quarter of the wavelength of the medium of the corresponding frequency band. The angle between the two bending segments 212 of the two first radiation lines 21 has a range of up to 70°; and the angle between the two second radiation lines 31 has a range of up to 110°; thus, the high-frequency gain can be optimized under the condition of setting with a small size, and the low-frequency gain is increased maximally.

The above description is only described with a preferred embodiment of the present utility model, and does not limit the protection scope of the present utility model. The equivalent structural modification made in light of the description and the drawings of the present utility model, or direct/indirect use of the present utility model in other related technical fields is included in the scope of protection of the present utility model.

The invention claimed is:

1. A planar antenna for digital television, comprising: a substrate; and a low-frequency radiation line and a high-frequency radiation line arranged on the substrate, wherein a length of the low-frequency radiation line is one quarter of a wavelength corresponding to a VHF frequency band, and a length of the high-frequency radiation line is one quarter of a wavelength corresponding to a UHF frequency band;

wherein the low-frequency radiation line comprises two first radiation lines arranged symmetrically and spaced apart, and the planar antenna for the digital television further comprises a coaxial cable, a signal line of the coaxial cable is electrically connected with one of the first radiation line, and a ground line of the coaxial cable is electrically connected with the other of the first radiation lines;

wherein the first radiation line comprises a connecting segment, a bending segment and a curved segment which are sequentially connected, and the connecting segments of the two first radiation lines extend in parallel, and the space between the two bending segments is arranged to increase from the connecting segments toward the curved segments;

wherein the connecting segment, the bending segment and the curved segment are enclosed to form an accommodating space, and the high-frequency radiation line comprises two second radiation lines arranged symmetrically and spaced apart, each of the second radiation lines being respectively connected to one of the connecting segments and housed in the accommodating space;

wherein the high-frequency radiation line further comprises two third radiation lines arranged symmetrically and spaced apart, the third radiation lines being arranged in a triangle; the two third radiation lines are correspondingly connected to the two second radiation lines; and one of the third radiation lines is electrically connected to the signal line of the coaxial cable, and the other of the third radiation lines is electrically connected to the ground line of the coaxial cable wherein the two third radiation lines are formed by coating with conductive silver paste.

2. The planar antenna for digital television according to claim 1, characterized in that, the middle of the two third radiation lines is arranged to be hollowed out.

3. The planar antenna for digital television according to claim 1, characterized in that, the substrate is a plastic sheet made of PC, or PVC, or PET, or APET, or PP, or PU; and the corresponding wavelengths of the VHF frequency band and the UHF frequency band are respectively medium wavelengths.

4. The planar antenna for digital television according to claim 1, characterized in that, the curved segments are arranged in a zigzag or serpentine shape.

5. The planar antenna according to claim 1, wherein the VHF frequency band is selected from the range group consisting of 88-108 MegaHertz and 174-230 MegaHertz.

6. The planar antenna according to claim 5, wherein the VHF frequency band is about 98 MegaHertz.

7. The planar antenna according to claim 5, wherein the VHF frequency band is about 202 MegaHertz.

8. The planar antenna for digital television according to claim 1, characterized in that, an angle between the two bending segments of the two first radiation lines ranges from 70° to 80°.

9. The planar antenna for digital television according to claim 1, characterized in that, an extended trajectory of the curved segment is arranged to coincide with a corner of the substrate.

* * * * *